US006382099B1

(12) United States Patent
Herrmann

(10) Patent No.: US 6,382,099 B1
(45) Date of Patent: May 7, 2002

(54) PRINTING APPARATUS AND METHOD FOR PREVENTING BARRING OR BANDING ON A PRINTED SUBSTRATE

(76) Inventor: Mark L. Herrmann, 4692 Ross Rd., Batavia, OH (US) 45103

( * ) Notice: Subject to any disclaimer, the term of this patent is extended or adjusted under 35 U.S.C. 154(b) by 0 days.

(21) Appl. No.: 09/312,786

(22) Filed: May 17, 1999

(51) Int. Cl.[7] ..... B41M 1/14

(52) U.S. Cl. ..... 101/211; 101/181; 101/216; 101/219; 101/401.1; 358/298

(58) Field of Search ..... 101/174, 181, 101/183, 211, 216, 219, 368, 395, 401.1, 483; 358/298

(56) References Cited

U.S. PATENT DOCUMENTS

| | | | | |
|---|---|---|---|---|
| 3,948,171 A | | 4/1976 | O'Connell | 101/211 |
| 4,037,533 A | | 7/1977 | Rapoport et al. | 101/211 |
| 4,196,451 A | | 4/1980 | Pellar | 358/283 |
| 4,259,905 A | | 4/1981 | Abiko et al. | 101/467 |
| 4,325,631 A | | 4/1982 | McCullion, Jr. | 355/77 |
| 4,903,123 A | | 2/1990 | Kawamura et al. | 358/75 |
| 4,916,545 A | | 4/1990 | Granger | 358/456 |
| 4,918,622 A | | 4/1990 | Granger et al. | 364/518 |
| 4,939,044 A | | 7/1990 | Obashi et al. | 428/654 |
| 4,977,458 A | | 12/1990 | Granger et al. | 358/456 |
| 5,053,887 A | | 10/1991 | Thompson | 358/457 |
| 5,055,923 A | * | 10/1991 | Kitagawa et al. | 358/75 |
| 5,067,025 A | | 11/1991 | Kitagawa | 358/298 |
| 5,247,883 A | * | 9/1993 | Kuwahara et al. | 101/170 |
| 5,255,085 A | | 10/1993 | Spence | 358/527 |
| 5,264,926 A | | 11/1993 | Rylander | 358/500 |
| 5,293,539 A | | 3/1994 | Spence | 358/527 |
| 5,295,434 A | | 3/1994 | Machii et al. | 101/211 |
| 5,309,246 A | | 5/1994 | Barry et al. | 358/298 |
| 5,320,038 A | | 6/1994 | Fischer | 101/177 |
| 5,323,245 A | | 6/1994 | Rylander | 358/536 |
| 5,367,673 A | | 11/1994 | Goldsmith et al. | 395/600 |
| 5,379,118 A | | 1/1995 | Steinhardt et al. | 358/298 |
| 5,446,558 A | | 8/1995 | Hamilton, Jr. et al. | 358/454 |
| 5,519,794 A | | 5/1996 | Sandor et al. | 382/285 |
| 5,526,143 A | | 6/1996 | Gershony et al. | 358/455 |
| 5,537,223 A | | 7/1996 | Curry | 358/460 |
| 5,570,633 A | | 11/1996 | Schultz et al. | 101/182 |
| 5,635,318 A | | 6/1997 | Van Hunsel | 430/11 |
| 5,680,222 A | * | 10/1997 | Ashworth | 358/298 |
| 5,831,659 A | * | 11/1998 | Baek et al. | 347/238 |

FOREIGN PATENT DOCUMENTS

GB 2281534 A 3/1995

OTHER PUBLICATIONS

Garett Long, *Final Report: Narrow–Web Flexographic Banding*, Flexo, Article, pp. 48–54, Aug. 1996.

* cited by examiner

*Primary Examiner*—Eugene Eickholt
(74) *Attorney, Agent, or Firm*—Wood, Herron & Evans, L.L.P.

(57) ABSTRACT

A method and apparatus for producing vignettes includes the use of a rotary printing member having an outer surface with a series of elongated printing dots. The lengthwise dimension of the dots extends substantially in the machine direction of the printing press, i.e., in a direction perpendicular to the axis of rotation of the printing member. For producing vignettes, the dots increase in density in a direction parallel to the linear direction and have a width which is substantially less than the length. For process printing operations, each color of the process printing is laid down by a series of dots extending substantially in the machine direction, although the screen angles of each series of dots may vary.

13 Claims, 5 Drawing Sheets

PRINTING APPARATUS AND METHOD FOR PREVENTING BARRING OR BANDING ON A PRINTED SUBSTRATE

FIELD OF THE INVENTION

The present invention relates generally rotary printing apparatus and methods and, more particularly, to operations in which a series of minute dots are transferred from a rotary printing member to a substrate in order to produce vignettes or other printed subject matter.

BACKGROUND OF THE INVENTION

The present invention generally involves two types of printing operations. In the first type, a rotating printing member transfers a series of minute dots with a gradually changing density onto a substrate until they fade into the background color, which may be white or another color. This particular type of printed substrate is referred to as a vignette. FIG. 1 shows a typical printing apparatus 10, which may be a flexographic printing press, including a print cylinder 12 with a flexographic printing plate 14. An impression cylinder 16 forces a substrate, such as a web of material 18, against print cylinder 12 as the print cylinder 12 and impression cylinder 16 rotate and the web 18 translates therebetween in a linear direction. In this manner, a vignette 20 may be produced on substrate 18.

As shown in FIG. 1, vignette 20 is particularly susceptible to visible imperfections known in the industry as barring, banding, streaking or gear marking. Specifically, one or more darkened bars or bands 22 can materialize on the vignette 20 in a direction perpendicular to the machine direction or, in other words, the direction of the substrate 18 moving past the rotating print cylinder. Often, this barring or banding phenomenon occurs for unexplainable reasons. The human eye perceives these bars or bands much more readily in vignettes as the color gradually transitions from a darker region to a fully faded region. The most problematic area of a vignette tends to be between about 15% and 70% dot coverage or density.

As further shown in FIG. 1A, typical dots used to produce single color vignettes are round. A bar or band may be produced when the machine components of the printing apparatus 10 cause even a very slight difference in speed between the rotating print cylinder 12 and the moving substrate 18. Essentially, this causes a very slight skidding effect between the substrate 18 and the print cylinder 12 which causes dots 24 to deform into dots 26 in region 22. Thus, dots 24 have the intended diameter D1, while dots 26 have a diameter D2 which is increased in the machine direction 28. The sporadic, relative movement between print cylinder 12 and substrate 18 is typically less than 0.001 inch. Many in the industry believe that the barring or banding effect arises due to the imperfect tolerances between moving parts of the printing press, such as in the gearing which drives the various cylinders. However, numerous attempts to improve the mechanics of a printing press have failed to prevent the barring or banding phenomenon. Moreover, barring or banding arises very often in a sporadic and unpredictable fashion making the true cause of these imperfections very illusive.

Other attempts to reduce the amount of banding or barring involve the use of particular types of substrates. For example, an article entitled *Final Report: Narrow Web Flexographic Banding* in the August 1996 issue of Flexo magazine suggests that rough, absorbent substrates should be used to decrease the instances of barring or banding. However, as mentioned in the article, these substrates tend to be lower quality substrates. Also, while the use of a particular type of substrate may or may not prevent or reduce the visibility of these imperfections, changing the type of substrate is simply not possible for many applications.

The other type of printing to which the present invention is directed is referred to as process printing. In process printing, multiple series of dots are laid down on a substrate one color at a time to produce a pattern and ultimate color desired for a particular application. In one conventional type of process printing, referred to as a four color process, four print cylinders may be used to successively lay down the colors yellow, magenta, cyan and black. To prevent so-called moiré patterns from becoming visible, the series of dots are laid down at different angles, typically referred to as screen angles. Similar, but often less noticeable problems exist with this type of printing and can result in imperfections, such as banding or barring.

To address problems in the rotary printing industry, such as those problems mentioned above, it would be desirable to provide printing methods and apparatus which significantly reduce or prevent visible banding or barring on printed substrates.

SUMMARY OF THE INVENTION

In one aspect, the present invention provides a method of producing a vignette and preventing barring or banding during a rotary printing operation. The method includes moving a substrate in a linear direction or, in other words, in the machine direction with respect to a rotary printing member. The rotary printing member has an outer surface with a series of elongated printing dots configured to produce an image on the substrate. The dots have a length extending substantially in the linear direction, and the dots increase in density in a direction parallel to the linear direction. The dots have widths extending perpendicular to their lengths and the widths of the dots are substantially less than their respective lengths. Preferably, the width of each dot is between about 10% and about 50% of the length. The lengthwise extents of the dots preferably extend parallel to the machine direction, however, a deviation of about 10° may be acceptable for certain applications. Preferably, only a single color is used in producing the vignette. The method further involves applying a printing medium, such as ink, to the elongated printing dots and transferring the printing medium from the rotary printing member to the substrate to produce the vignette.

Although the vignette may be produced in accordance with the invention using a number of different types of rotary printing apparatus, one preferred type of apparatus is a flexographic printing apparatus using at least one flexographic plate secured to a rotary printing cylinder. Using apparatus such as a flexographic printing press, the transfer of the printing medium is a direct transfer from the printing cylinder to the substrate, such as by impression against the printing cylinder using an impression cylinder. Other printing apparatus may indirectly transfer ink from a series of rotating members to the moving substrate. Other types of printing apparatus capable of use in accordance with the invention include rotogravure presses, letter presses, offset presses, FM screening presses and stochastic presses.

The invention further contemplates a rotary printing member for printing a vignette on a substrate, such as by using the method described above. The printing member may comprise a cylinder or other rotary printing member. In the specific case of a flexographic printing member, a flexible plate, which may be conventionally formed of a thermoplastic material, may be chemically etched according to conventional pre-press procedures to have the unique dot structure of the invention. The dots are formed as raised, elongated printing dots. In the preferred embodiment of the invention, the dots will have a length extending within about 10° of the linear direction or machine direction as the printing medium is being transferred to the substrate. It has been found most preferred to have the unique dot structure of the invention exist in printed regions having a dot coverage or density of between about 40% and 50%. More generally, the problem of barring or banding appears to be most visible to the human eye in a density region between about 15% dot coverage and about 70% dot coverage.

The invention further contemplates a rotary printing member for printing a vignette on a substrate, such as by using the method described above. The printing member may comprise a cylinder or other rotary printing member. In the specific case of a flexographic printing member, a flexible plate, which may be conventionally formed of a thermoplastic material, may be chemically etched according to conventional pre-press procedures to have the unique dot structure of the invention. The dots are formed as raised, elongated printing dots. In the preferred embodiment of the invention, the dots will have a length extending within about 10° of the linear direction or machine direction as the printing medium is being transferred to the substrate. It has been found most essential to have the unique dot structure of the invention exist in printed regions having a dot coverage or density of between about 40% and 50%. More generally, the problem of barring or banding appears to be most visible to the human eye in a density region between about 15% dot coverage and about 70% dot coverage.

The present invention further contemplates a rotary printing member for use in a process printing operation, such as the method described above. In accordance with the invention, and like the printing member used for producing a vignette, this printing member will have elongated dots extending in the machine direction or, in other words, perpendicular to the axis of rotation of the printing member. In the preferred embodiment, the length dimension of these dots extends parallel to the machine direction, however, a deviation of, for example, about 10° may be acceptable for various applications as discussed above. In process printing, for example, it is important to have the darker colors, or more prominent colors, extending directly in the machine direction. Other, less noticeable colors may deviate from the machine direction. Especially for dark colors, a screen angle of more than 10° should not result in dots having their length dimensions also angling at the screen angle. In other words, while a substantial screen angle of each set of dots may be used to prevent moiré patterns, the lengthwise dimensions of the elongated dots should still extend within the confines described above.

According to the invention, the dots are configured so that when skidding or relative movement takes place between the moving substrate and the rotating printing member or cylinder, a minimal amount of increased ink is laid down along the line of contact between the substrate and the print member. Thus, the barring or banding previously perceived becomes masked and invisible to the human eye. Printing an elongate dot, such as an elliptical dot, with the longest extent running in the machine direction reduces the amount of skid gain. That is, the area of ink along the dots located at the line of the skid is not increased nearly as much as when using conventional round dots. It is also generally desirable to chain link the elongated dots, also in the machine direction, to further prevent visible barring or banding in the printed subject matter.

These and other objects, advantages and features of the invention will become more readily apparent to those of ordinary skill in the art upon review of the following detailed description of the preferred embodiments taken in conjunction with the accompanying drawings.

DETAILED DESCRIPTION OF THE PREFERRED EMBODIMENTS

Figure 2:
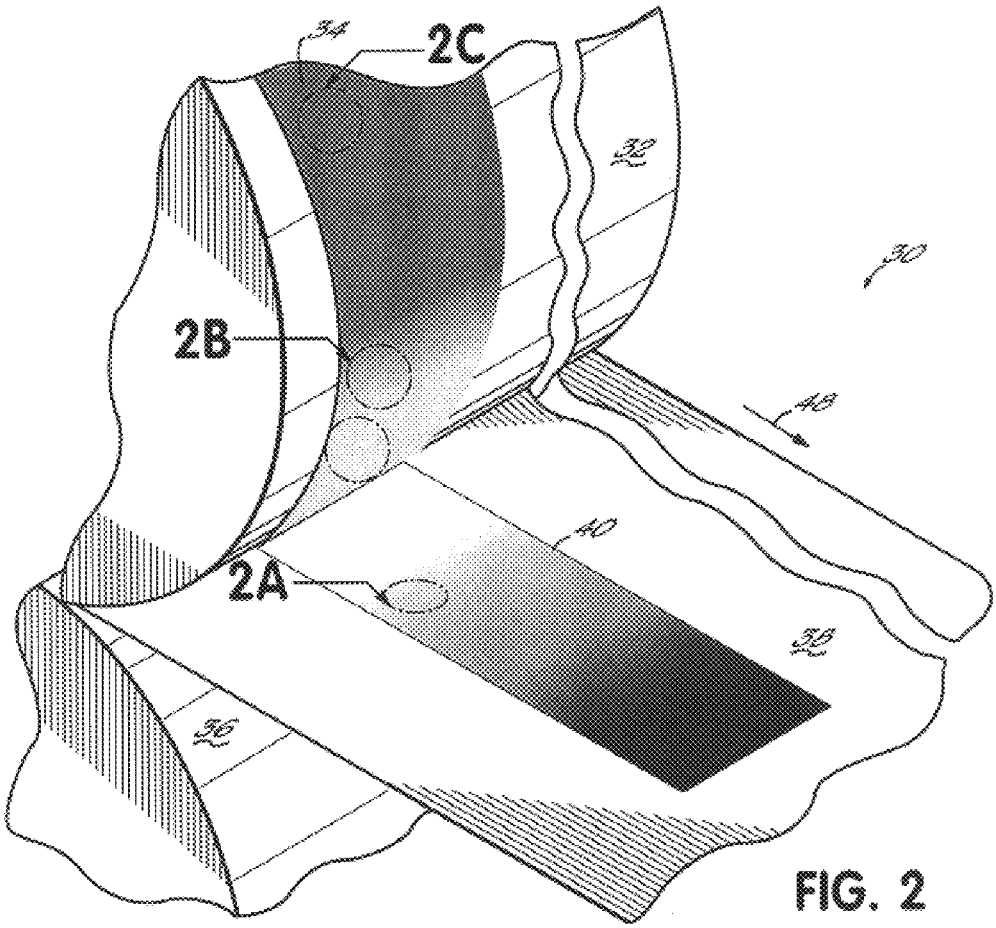
FIG. 2 is a fragmented perspective view of a printing apparatus as used to produce a vignette according to the invention.

FIG. 2 illustrates a printing apparatus 30, generally shown as a flexographic printing apparatus. It will be appreciated that other rotary printing presses may be used in carrying out the present invention. In general, apparatus 30 includes a print roll 32 having a flexographic plate 34 secured thereto, as with conventional two-sided adhesive tape (not shown). A conventional impression roll 36 forces a substrate 38 against print roll 32. Substrate 38 will typically be a web of material, such as paper, moving in a linear direction tangent to the rotating print roll 32 and the oppositely rotating impression roll 36. Other processes may use individual sheets of material as the substrate. A more complete description of a suitable flexographic, in-line printing press is contained in U.S. Pat. No. 5,570,633, assigned to the assignee of the present invention and the disclosure of which is hereby fully incorporated by reference. In accordance with one aspect of the invention, the flexographic printing plate 34 is formed to produce a vignette 40 on substrate 38. As shown, vignette 40 fades in color gradually from a darker region to the background color. In this case, the background is white but it may be other colors as well.

Figure 1:
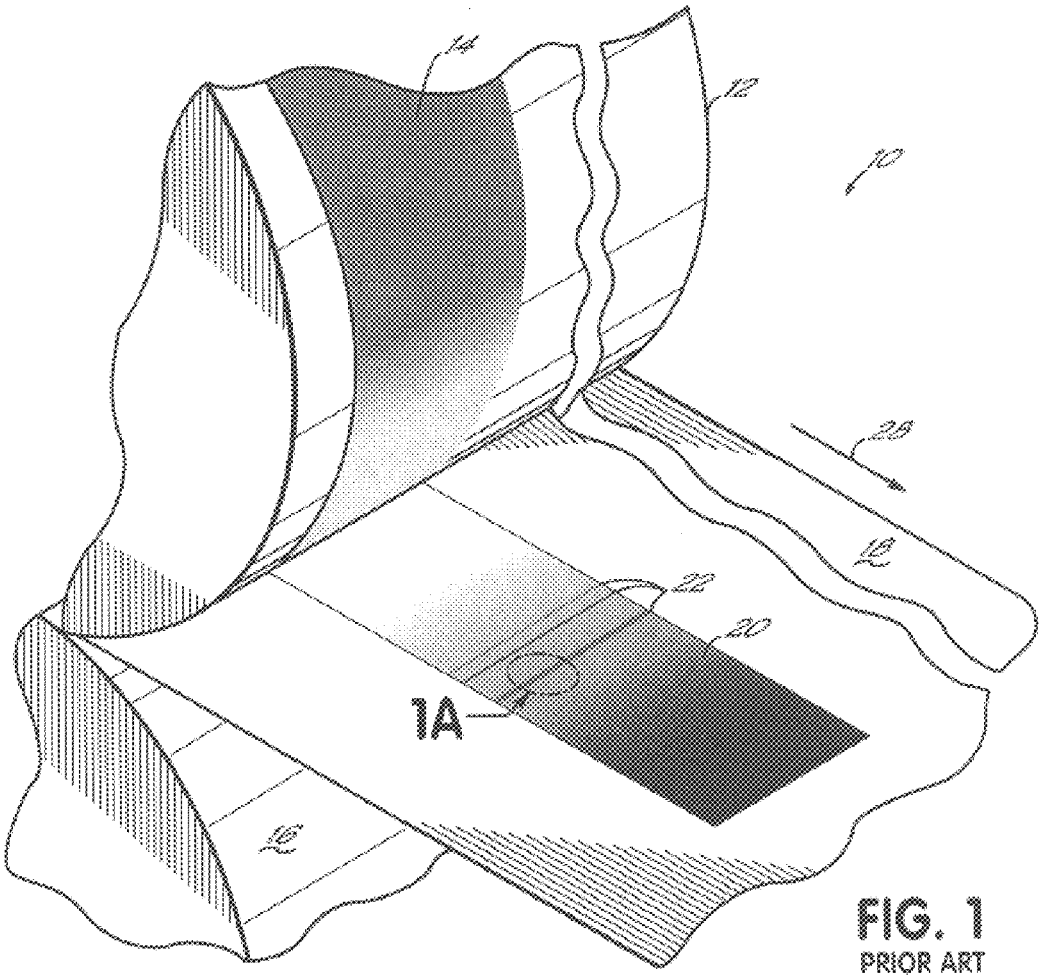
FIG. 1 PRIOR ART
FIG. 1 is a fragmented perspective view of a prior art printing apparatus producing a vignette.
Figure 1A:
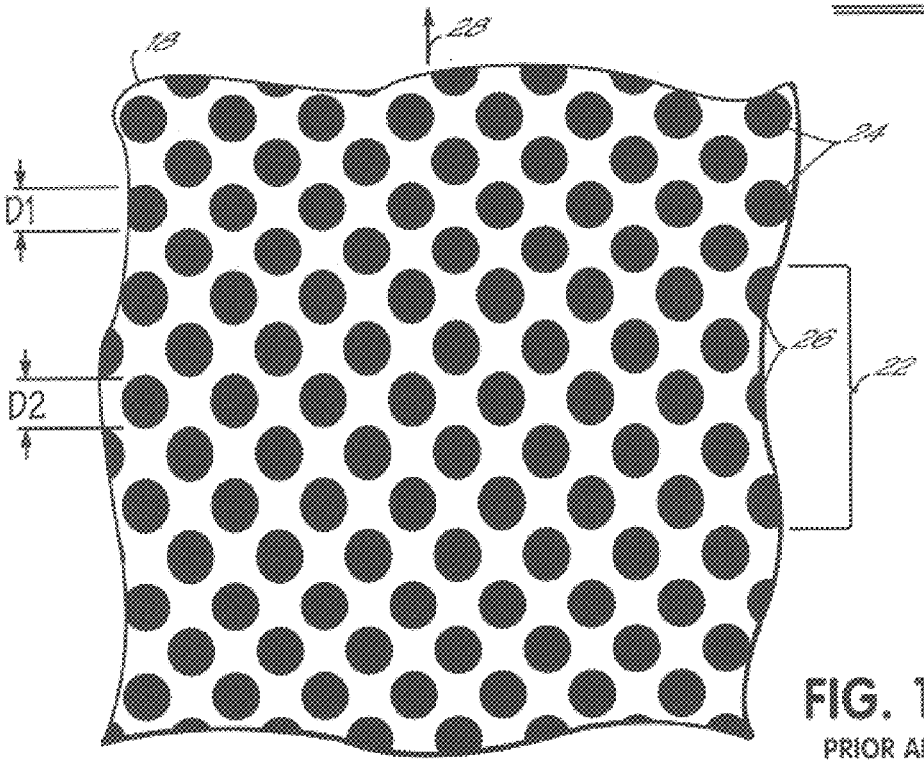
FIG. 1A PRIOR ART
FIG. 1A is an enlarged view of encircled portion 1A of FIG. 1.
Figure 2A:
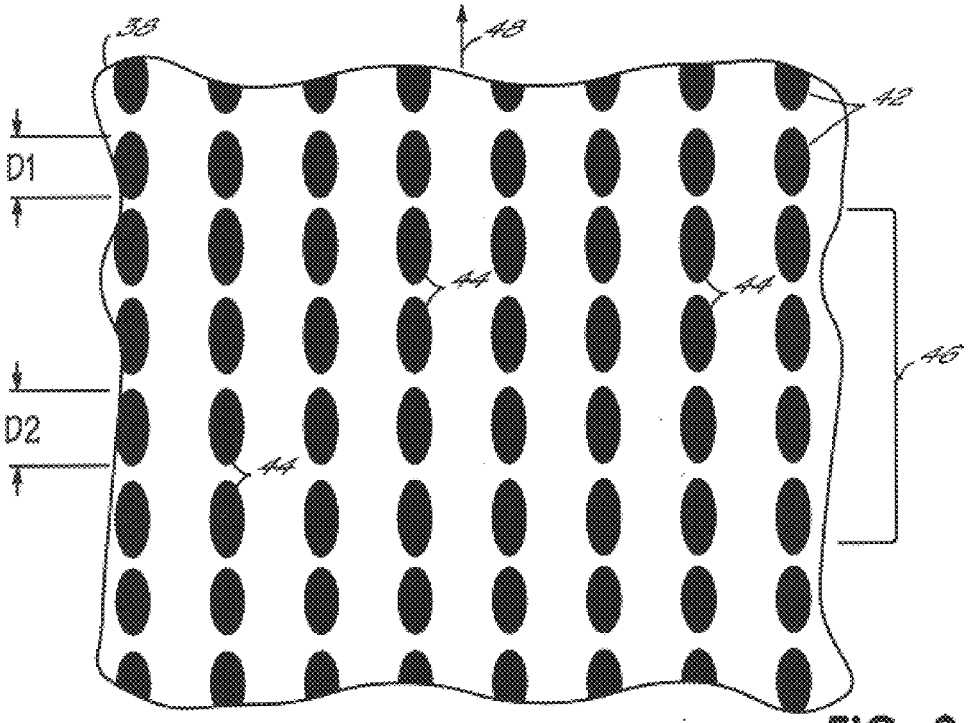
FIG. 2A is an enlarged view of encircled portion 2A of FIG. 2.

As best shown in FIG. 2A, flexographic printing plate 34 is used to lay down a series of elongate dots 42 on substrate 38. As further shown, a plurality of rows of these dots may be deformed as dots 44 in a skid region 46. In typical rotary printing processes, such as described in connection with FIGS. 1 and 1A, this will lead to one or more visibly darker bars or bands across the vignette. However, in the present invention these deformed, elongated dots 44 do not form a visible bar or band on vignette 40. In this regard, the increased area of ink laid down in each deformed dot 44 is minimal as compared to conventional, round dots. While the length D1 of dots 42 may increase by 10–15% to D2 in region 46, this will not lead to visible bars or bands due to the dot orientation and reduced dot width versus length. Although the differences between deformed region 22 shown in FIG. 1A and deformed region 46 shown in FIG. 2A are not readily discernable at the magnified level visible bands or bars surprisingly result from the dot structure shown in FIG. 1A, whereas such visible bars or bands do not materialize according to the invention as exemplified by FIG. 2A. It is important that the respective lengthwise dimension of dots 42 extend at least substantially in the machine direction indicated by arrow 48. This refers to the direction of movement of substrate 38 as the ink is being transferred at the junction of print cylinder 32 and impression roll 36. It may be possible to orient elongate dots 42 as much as about 10° off of the machine direction, while still realizing benefits of the invention in certain applications, such as at certain lower intensity colors. However, it is most desirable to have the lengthwise extents of dots 42 directly parallel to the machine direction.

Figure 2B:
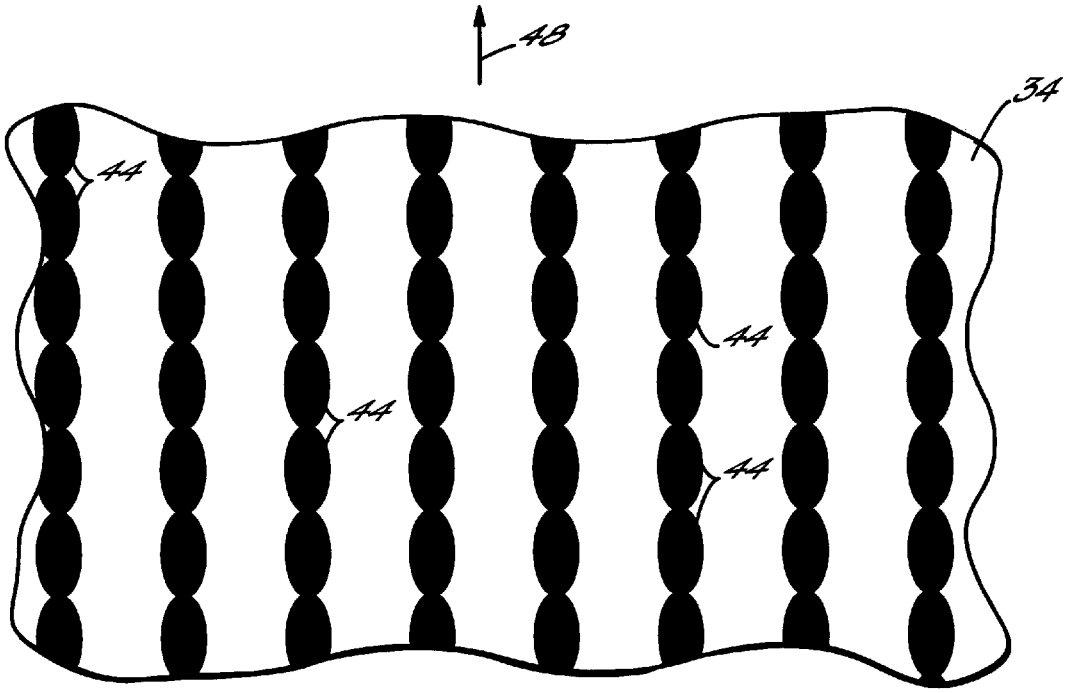
FIG. 2B is an enlarged view of encircled portion 2B of FIG. 2.
Figure 2C:
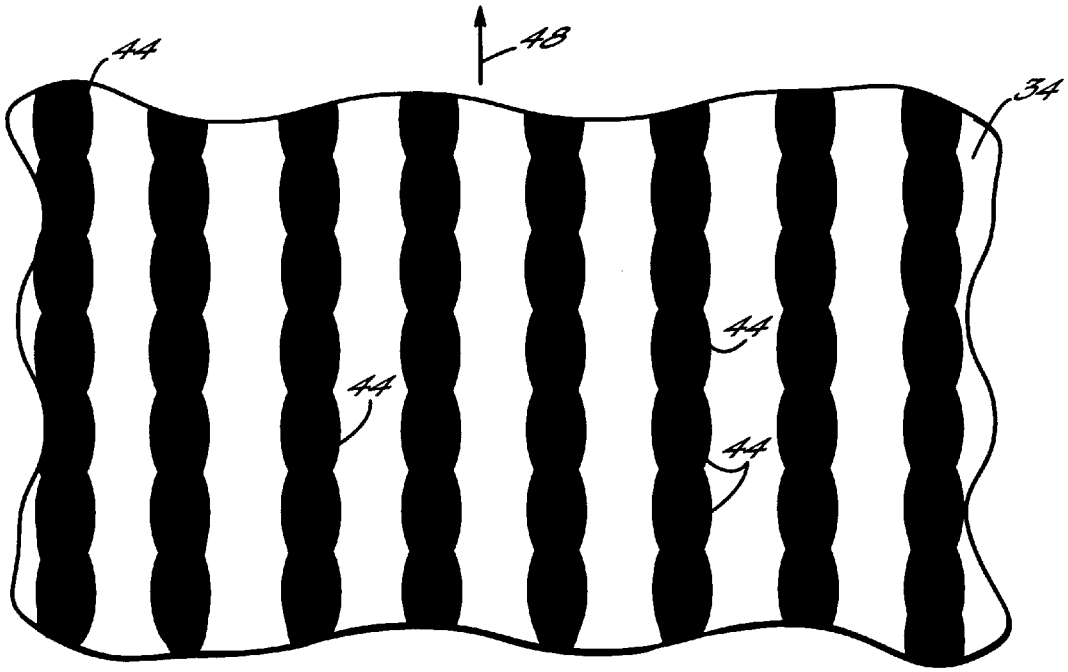
FIG. 2C is an enlarged view of encircled portion 2C of FIG. 2.

FIGS. 2B and 2C are taken from respective lighter and darker regions of flexographic plate 34. Essentially, these figures show a chain linking effect of elongated dots 42*a* which is preferred when increasing the dot coverage or density for darker regions of vignette 40. This chain linking effect further prevents visible barring or banding. In this regard, deformations in the machine direction are masked by having the elongate dots 42*a* merge with one another along the machine direction.

Figure 3A:
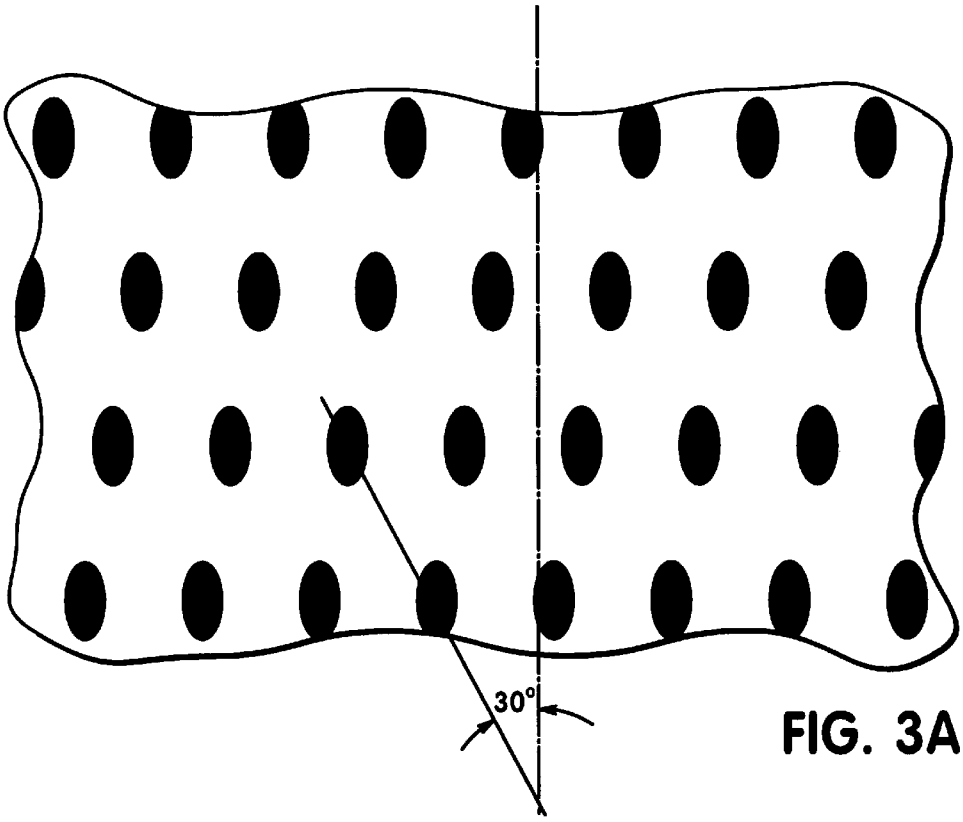
FIG. 3A is an enlarged view similar to FIG. 2A, but showing a dot pattern used during a process printing operation.
Figure 3B:
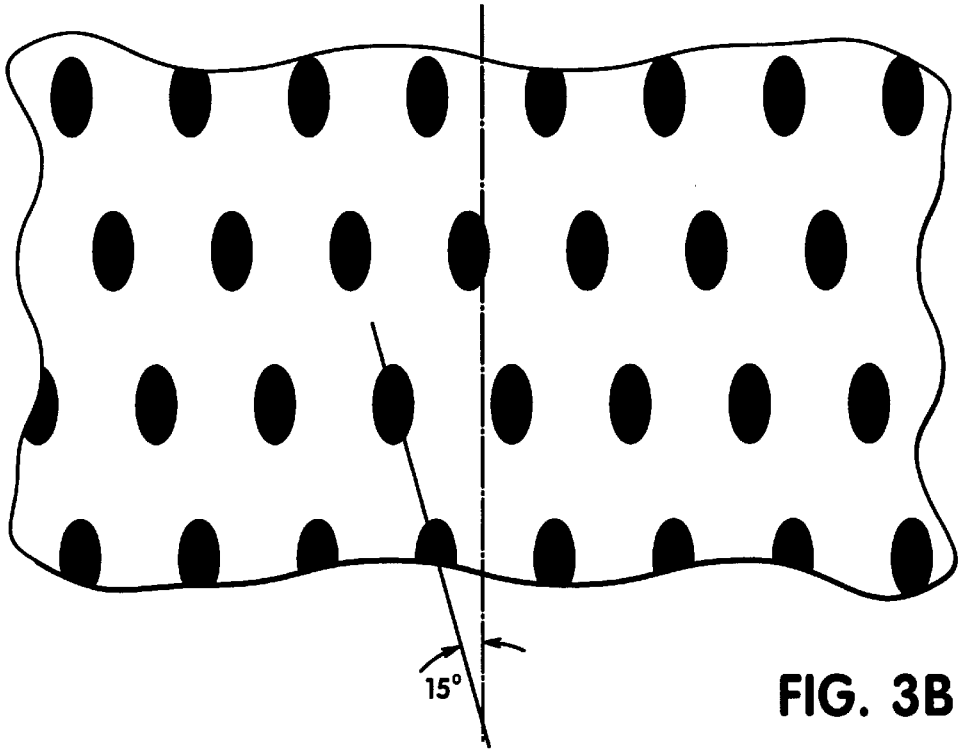
FIG. 3B is an enlarged view of another rotary printing member similar to FIG. 3A, but showing a dot pattern at a different screen angle.
Figure 3C:
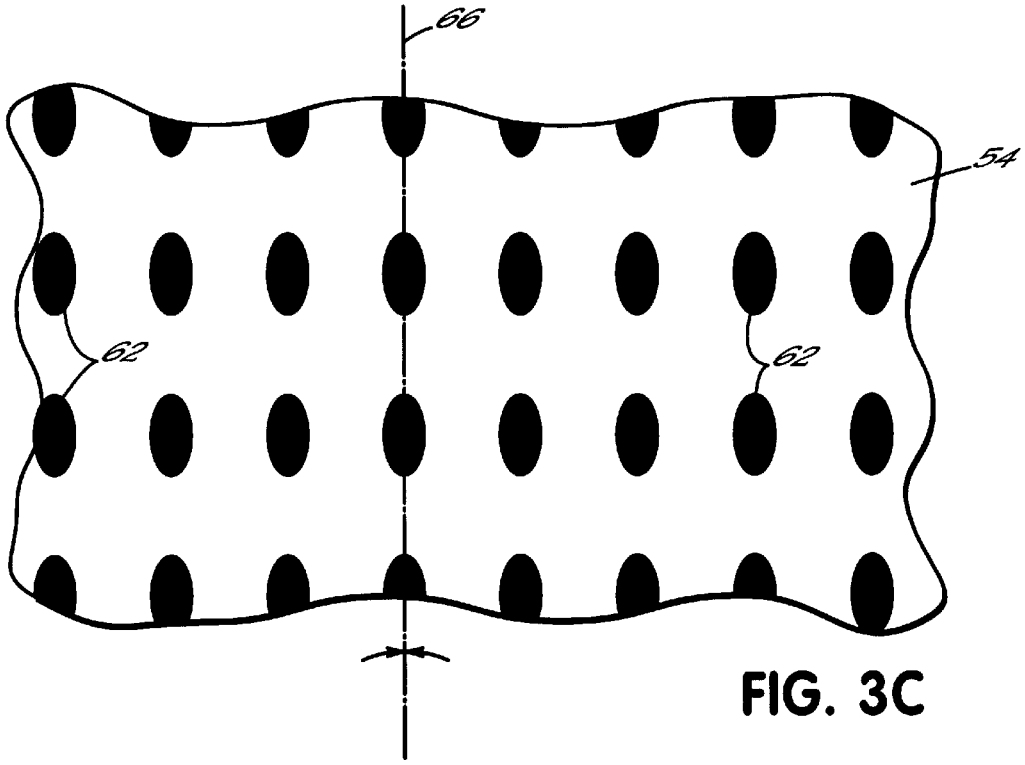
FIG. 3C is an enlarged view similar to FIGS. 3A and 3B, but showing a dot pattern of another color shown at yet another screen angle.
Figure 3D:
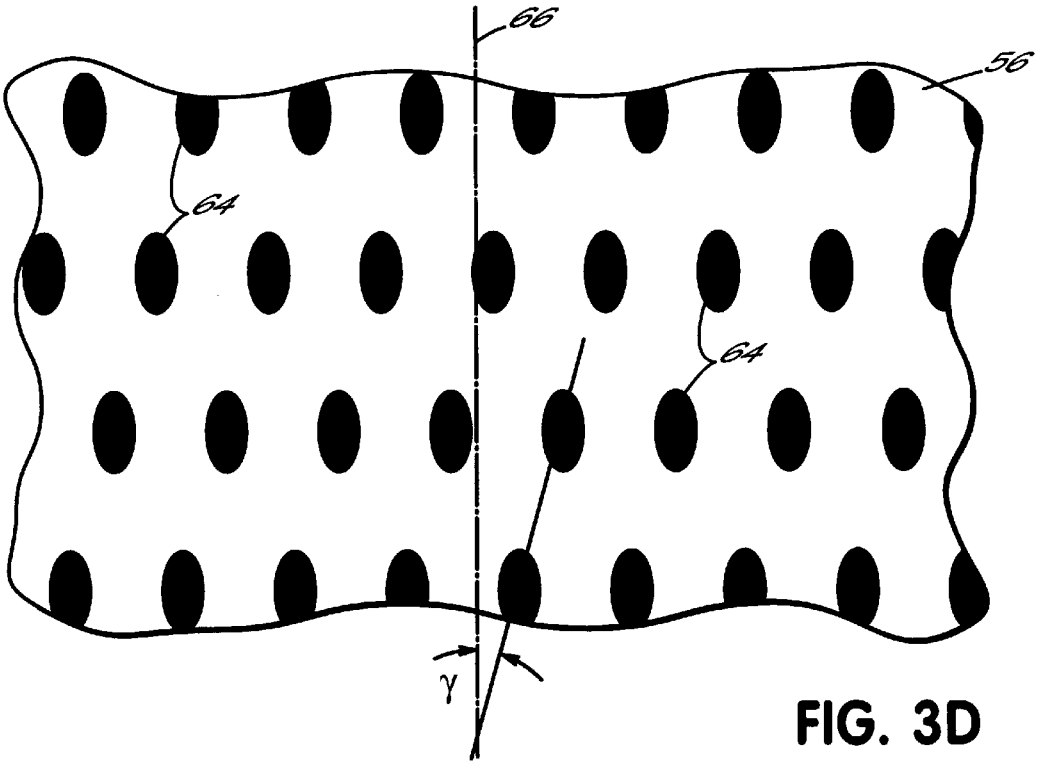
FIG. 3D is an enlarged view similar to FIGS. 3A–3C, but showing another printing member having a dot pattern of another color at yet another screen angle.

FIGS. 3A–3D illustrate enlarged views of respective flexographic printing plates, or other rotary printing members, 50, 52, 54, 56. Each of these printing members may be used to lay down a different color in a process printing operation. According to the invention, each of the elongate printing dots 58, 60, 62, 64 on these respective printing plates or members 50, 52, 54, 56 extends at least substantially in the machine direction, represented by axis 66, as discussed above. This is despite the fact that the screen angle of the respective elongate dots 58, 60, 62, 64 may be significantly different. In FIG. 3A, a screen angle $\alpha$ is shown, which may be −30°. In FIG. 3B, a screen angle $\beta$ is shown which may be −15°. In FIG. 3C, a dot orientation is used as shown in the first embodiment of this invention, i.e., with a 0° screen angle. In FIG. 3D, a screen angle $\gamma$ is shown and may be 15°.

For certain applications, it may only be necessary to have the most prominent color or colors, or darkest colors, formed with elongate dots oriented at least substantially in the machine direction as discussed herein. This is because lighter or less prominent colors may not create visible barring or banding when there is a discrepancy between the speed of the substrate and the speed of the rotating printing member. Also, as with the printing of vignettes according to the invention, it is preferred to have the lengthwise extents of all the elongate dots oriented at least substantially in the machine direction, however, for certain applications it may only be necessary to orient the dots in only the most problematic density regions in the machine direction. As stated above, this is presently contemplated to be in about the 15%–70% density region and, especially, in the 40%–50% density region.

While the present invention has been illustrated by a description of the preferred embodiment and while this embodiment has been described in some detail, it is not the intention of the Applicant to restrict or in any way limit the scope of the appended claims to such detail. Additional advantages and modifications will readily appear to those skilled in the art. This has been a description of the present invention, along with the preferred methods of practicing the present invention as currently known.

However, the invention itself should only be defined by the appended claims, wherein I claim:

1. A method of producing a vignette using a single color of ink and preventing barring or banding during a rotary printing operation, the method comprising:

moving a substrate in a linear direction with respect to a rotary printing member having an outer surface with a series of elongated printing dots to collectively produce an image on the substrate, said dots having a length extending at least substantially in said linear direction and a width extending perpendicular to said length, wherein said width is less than about 50% of said length and said printing dots on said printing member collectively cover an increasingly larger percentage of the outer surface of the printing member per unit area of said image in a direction parallel to said linear direction, applying a printing medium to the elongated printing dots on said rotary printing member, and transferring the printing medium from said rotary printing member to said substrate to produce said vignette.

2. The method of claim 1, wherein said width is about 10% to about 40% of said length.

3. The method of claim 1, wherein said rotary printing operation is a flexographic printing operation and the rotary printing member includes a flexographic plate.

4. The method of claim 1, wherein the lengths of said dots extend substantially parallel to said linear direction.

5. The method of claim 1, wherein the printing member comprises a printing cylinder and the step of transferring the printing medium further comprises:

directly transferring the printing medium from the printing cylinder to the substrate by impressing the substrate against the printing cylinder with an impression cylinder.

6. A method of producing a vignette and preventing barring or banding during a flexographic printing operation, the method comprising:

moving a substrate in a linear direction with respect to a printing cylinder including a flexographic printing plate having a series of raised, elongated printing dots thereon collectively corresponding to a desired image, said dots having a length extending substantially in said linear direction and a width extending perpendicular to said length, wherein said width is substantially less than said length and said printing dots collectively cover an increasingly larger percentage of the printing plate per unit area of said desired image in a direction parallel to said linear direction, applying a printing medium to the elongated printing dots on said flexographic printing plate, and transferring the printing medium from said flexographic printing plate to said substrate to produce said vignette.

7. The method of claim 6, wherein said width is about 10% to about 50% of said length.

8. The method of claim 7, wherein the lengths of said dots extend substantially parallel to said linear direction.

9. A rotary printing member for printing a vignette on a substrate moving through a printing press in a linear direction, the printing member having an axis of rotation and further comprising:

a printing surface with a series of elongated printing dots collectively corresponding to a desired image to be printed and adapted to receive a printing medium to be transferred to the substrate, said dots having a length extending at least substantially parallel to said linear direction and at least substantially perpendicular to said axis of rotation as said printing medium is being transferred to the substrate, and a width extending perpendicular to said length, wherein said width is substantially less than said length, wherein said printing dots collectively cover an increasingly larger percentage of the printing surface per unit area of said desired image in a direction parallel to said linear direction.

10. The rotary printing member of claim 9, wherein said width is between about 10% and 50% of said length.

11. The rotary printing member of claim 9, wherein said printing member further comprises a flexographic printing plate secured to a rotary print cylinder.

12. A flexographic printing plate for printing a vignette on a substrate moving through a printing press in a linear direction, the printing plate having a printing surface comprised of a series of elongated, raised printing dots for receiving a printing medium to be transferred to the substrate to produce a desired image, said dots each having a length and a width and collectively having a density, the density being defined as a percentage of the printing surface covered collectively by said dots, said length extending within about 10° of said linear direction as said printing medium is being transferred to the substrate, said density gradually increasing in a direction parallel to said linear direction and ranging up to a maximum of 100% density, and said width extending perpendicular to said length, wherein said width is substantially less than said length at least in the density range between 40% to 50%.

13. A method of process printing comprising:

moving a substrate in a linear direction with respect to at least first and second rotary printing members each having a series of elongated printing dots disposed thereon at different screen angles, said dots on each printing member each having a length extending at least substantially in said linear direction and each having a width extending perpendicular to said length, wherein said width is less than about 50% of said length, applying a printing medium of a first color to the elongated printing dots on said first rotary printing member, transferring the printing medium from said first rotary printing member to said substrate to produce a pattern with said first color, applying a printing medium of a second color to the elongated printing dots on said second rotary printing member, and transferring the printing medium of said second color from said rotary printing member to said substrate to produce a pattern with said second color and to thereby produce a third color visible to the human eye.

* * * * *